US008235730B2

(12) United States Patent
Adachi

(10) Patent No.: US 8,235,730 B2
(45) Date of Patent: Aug. 7, 2012

(54) SUBSTRATE CONNECTOR

(75) Inventor: Kiyoshi Adachi, Kanagawa (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/521,407

(22) PCT Filed: Dec. 20, 2007

(86) PCT No.: PCT/US2007/026087

§ 371 (c)(1),
(2), (4) Date: Feb. 24, 2010

(87) PCT Pub. No.: WO2008/085389

PCT Pub. Date: Jul. 17, 2008

(65) Prior Publication Data

US 2010/0173506 A1 Jul. 8, 2010

(30) Foreign Application Priority Data

Dec. 27, 2006 (JP) ..... 2006-351911

(51) Int. Cl.
*H01R 12/00* (2006.01)

(52) U.S. Cl. ..... 439/66

(58) Field of Classification Search ..... 439/66
See application file for complete search history.

(56) References Cited

U.S. PATENT DOCUMENTS

| | | | | |
|---|---|---|---|---|
| 6,079,988 | A * | 6/2000 | Hashiguchi et al. | 439/66 |
| 6,296,495 | B1 | 10/2001 | Wang et al. | |
| 6,749,440 | B1 * | 6/2004 | Szu et al. | 439/66 |
| 6,821,163 | B2 * | 11/2004 | McHugh et al. | 439/733.1 |
| 6,914,192 | B2 | 7/2005 | Ju | |
| 6,916,186 | B2 * | 7/2005 | Szu et al. | 439/86 |
| 7,052,284 | B2 * | 5/2006 | Liao et al. | 439/66 |
| 7,377,789 | B1 * | 5/2008 | Liu | 439/66 |
| 7,520,752 | B2 * | 4/2009 | McAlonis | 439/66 |

FOREIGN PATENT DOCUMENTS

JP 09-073960 3/1997

OTHER PUBLICATIONS

International Search Report and Written Opinion for PCT Patent Application No. PCT/US2007/0026087. May 21, 2008.

* cited by examiner

*Primary Examiner* — Truc Nguyen
(74) *Attorney, Agent, or Firm* — Timothy M. Morella

(57) ABSTRACT

A substrate connector utilizes a plurality of conductive terminals, each of which are held in a single terminal-receiving cavity of a substrate. The terminals of the connector have a hook-shape with a retention portions in the form of a fork having a central slot and two free ends spaced apart from the retention portion and which protrude out of their cavities for contacting contact pads on opposing circuit boards. The retention portions engage abutments formed in the cavities to hold the terminals in place but do so in a manner that permits the terminals to move in both the vertical and horizontal directions.

7 Claims, 11 Drawing Sheets

SUBSTRATE CONNECTOR

BACKGROUND OF THE INVENTION

The present invention relates generally to a substrate connector, and more particularly to substrate connector with improved contact force characteristics.

Conventional flat connectors that use a large number of terminals are used to connect a semiconductor device to a circuit board or to connect two substrates with each other. An example is shown in Japanese Patent Application Laid-Open (Kokai) No. 08-222335). FIG. 13 is a cross-sectional view of a conventional connector.

In FIG. 13, 801 represents a connector housing that has an upper housing 803 with an opening 804 and a lower housing 805 with a bore 806. 810 is a connector terminal provided with a base 811 mounted in the bore 806, a contact arm 813 that is bent from the base 811 and extending upward, and a contact part 812 protruding downward from the lower end of the base portion 811. When the terminal 810 is inserted into the bore 806 from above, the lower end of a wing 815 protrudes sideways from the terminal 810 and abuts against the bottom surface 808 of a groove 807 in the side of the bore 806 which limits the downward movement of the terminal 810. A portion of the upper surface of the bore 806 is covered by the upper housing 803 in order to restrict upward movement of the terminal 810. Hence, the terminal 810 is prevented from coming loose from the bore 806 and is firmly held by the housing 801.

Further, the terminal contact part 812 protrudes downwardly more than the bottom surface of the lower housing 805 and comes into contact with a conductive pad 821 formed on the upper surface of the substrate 820. A solder ball 831 formed on the lower surface of the semiconductor device 830 is kept in contact with a tip end part 814 of the contact piece 813 of the terminal 810. This provides electrical continuity between the conductive pad 821 and the solder ball 831 via the terminal 810.

In this type of connector the up and down movement of the terminal 810 is restricted, and when the spacing between the bottom surface of the lower housing 805 and the upper surface of the substrate 820 changes, this spacing change can only be absorbed within a range of plastic deformation permitted for the contact part 812 and the tip end part 814 of the terminal 801. When a change occurs that exceeds the range of elastic deformation, the terminal 810 is not permitted to smoothly move up and down and no longer keeps contact with the conductive pad 821. The semiconductor device 830 or the substrate 820 may include more and more terminals and become larger in its size and therefore, a variation in the vertical position of the solder ball 831 (or conductive pad 821) may increase, thereby preventing secure contact. In addition, vertical forces exerted by the semiconductor device 830 or the substrate 820 cannot be absorbed by the terminal 810, and the terminal 810 may buckle eventually, resulting in its breakage. It then becomes unable to stabilize the force, whereby the contact point 812 and the tip end part 814 contact the conductive pad 821 and the solder ball 831, respectively, which fails to keep secure connection. Additionally, because the upper and lower housings 803,805 are joined together to form the housing 801, the assembly process becomes complicated, resulting in an increase in cost. Furthermore, the terminal 810 cannot be removed from the housing 801, and thus the damaged terminal 810 cannot be replaced with a new terminal.

SUMMARY OF THE INVENTION

An object of the present invention therefore is to solve the above-mentioned problems encountered by the conventional substrate connector through provision of a reliable substrate connector in which a concave part provided in the terminal and is engaged with a convex part received in a terminal-receiving cavity formed so as to penetrate a plate-like housing, so that the terminal is held in the cavity and is permitted to vertically and laterally move therein, thereby absorbing variations in the space defined between the connector and the substrate while maintaining a reliable electric contact with the substrate, reducing the cost through a simplified structure, and permitting easy replacement of a terminal.

In order to achieve the above object, the present invention provides a substrate connector, which includes an insulative housing, and terminals mounted to the housing, in which one surface of the housing is opposed to a first substrate where first contact pads are arranged, and in which the other surface of the housing is opposed to a second substrate where second contact pads are arranged, and where the terminal provides a connection between the first contact pads of the first substrate and the second contact pads of the second substrate, and wherein the housing has cavities that accommodate the terminals, wherein each terminal is provided with a bifurcated mounting portion bifurcated. The terminal has a concave portion, or recess, formed in an outer edge thereof, and wherein the terminal-receiving cavity includes a convex part inwardly protruding from an inside surface thereof that engages with the concave portion to hold the terminal so that the terminal moves in the direction of thickness of the housing and in the width direction of the mounting portion.

In accordance with another embodiment of the present invention, there is provided a substrate connector, wherein the terminal includes: a first bending portion connected to an end of the mounting portion located adjacent to the first substrate; a body portion with an end located adjacent to the first substrate and connected to the first bending portion; a tilting portion connected to an end of the body portion that is adjacent to the second substrate and tilts in a direction opposite to a bending direction of the first bending portion; and, a second bending portion connected to an end of the tilting portion located close to the second substrate and bending in a direction opposite to the bending direction of the first bending portion.

In accordance with a further embodiment of the present invention, a substrate connector has a terminal that contacts the first contact pad at the first bending portion and with the second contact pad at the second bending portion thereof, while being elastically deformable so as to absorb variations in the distance between the first and second contact pads.

In accordance with a still further embodiment of the present invention, in the substrate connector, at least a portion of the first bending portion protrudes from one surface of the housing even when the terminal is positioned closest to the second substrate, and wherein at least a portion of the second bending portion protrudes from the other surface of the housing even when the terminal is positioned closest to the first substrate.

In accordance with a further embodiment of the present invention, there is provided a substrate connector, with a mounting portion having an upper convex portion and a lower convex portion protruding outward from an outer edge thereof to define the concave portion, and wherein a lower side of the lower convex portion closer to the first substrate contacts a convex part while inserted into the broad width part thus causing the bifurcated portion of the terminal to be elastically deformed and inwardly tilted.

In accordance with the present invention, a terminal is provided for use with a substrate connector in the context of a plate-shaped housing having one surface thereof opposed to a surface of a first substrate supporting first contact pads and the other surface is opposed to a surface of a second substrate supporting second contact pads; and, a terminal-receiving cavity is formed in the housing. The terminal is provided with a bifurcated mounting portion with two arms and each arm is formed with a concave portion thereof on an outer edge thereof, wherein the cavity is provided, with a broad width portion that is wider than the mounting portion and, wherein the mounting portion is accommodated in the broad width portion of the cavity and the terminal concave portion engages a convex part, or lug, protruding inward from an inside surface of the broad width portion of the cavity so that the terminal moves vertically and horizontally in the housing.

According to the present invention, the concave portion formed in the terminal engages the convex part formed in the housing cavity thereby permitting the terminal to be held so that it moves vertically and laterally in the cavity. Hence, variations in space between the substrate connector and a substrate are appropriately absorbed while maintaining contact with the substrate, reducing costs through a simplified structure, and allowing replacement of the terminal as required thereby enhancing the reliability.

DESCRIPTION OF THE PREFERRED EMBODIMENTS

Figure 1:
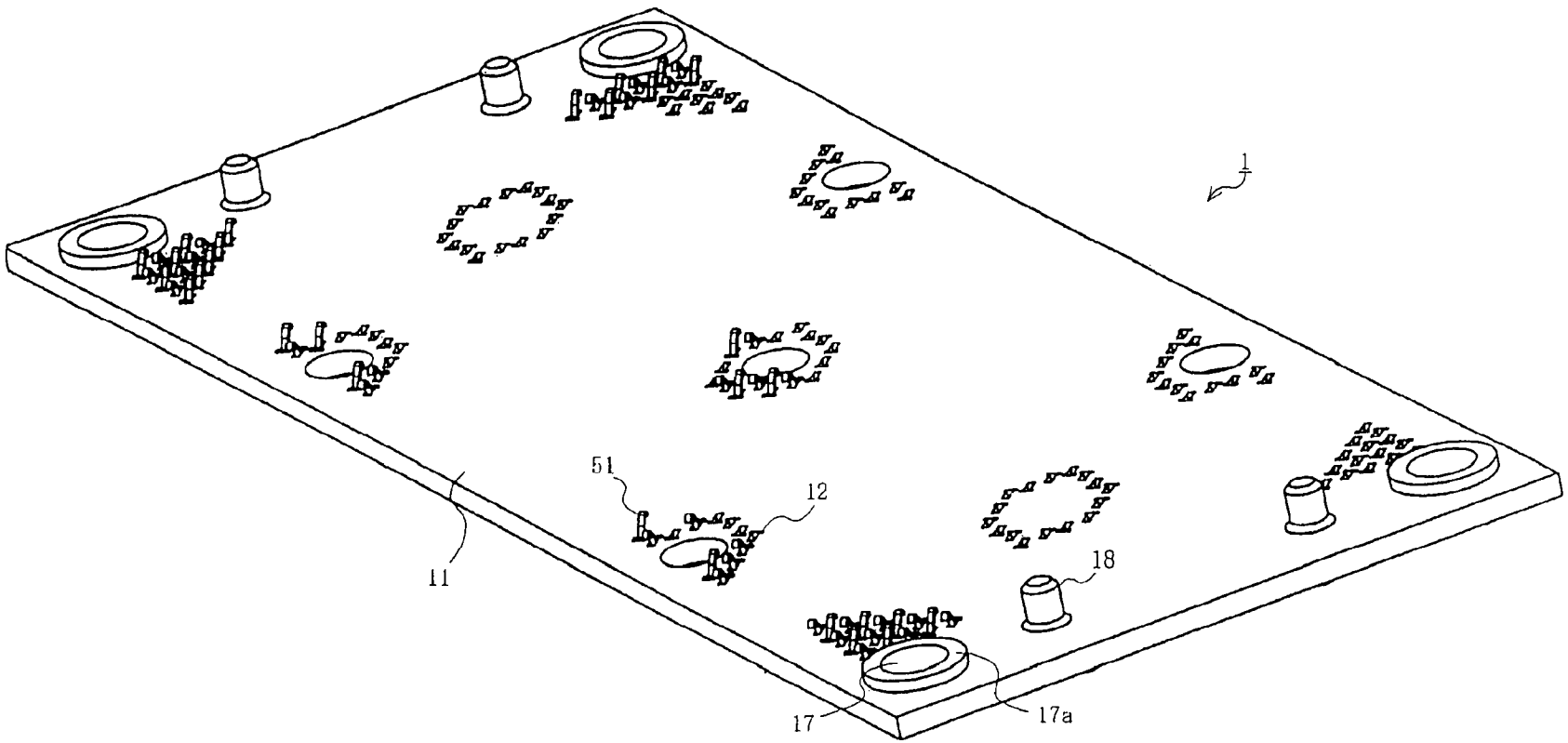
FIG. 1 is a perspective view showing a connector incorporating a first embodiment of the present invention.
Figure 2:
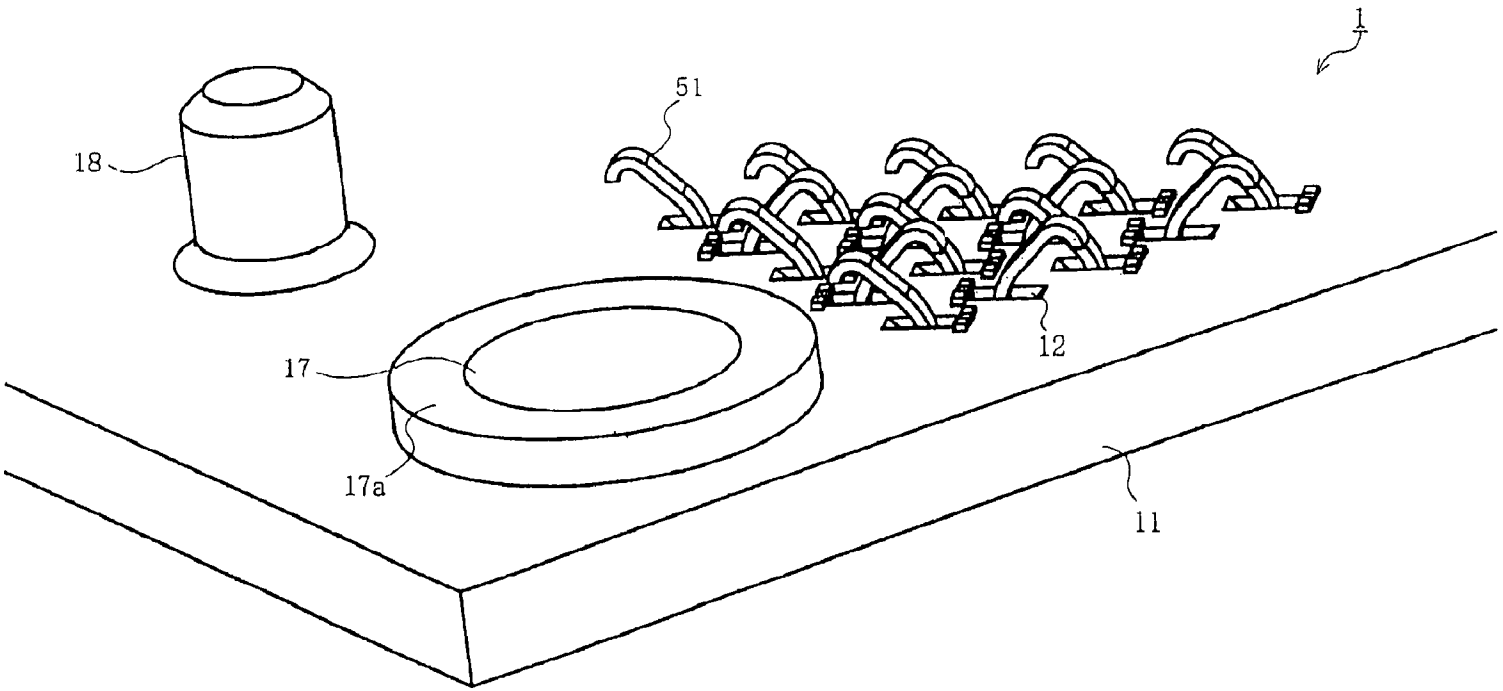
FIG. 2 is an enlarged view of important sections of the connector of FIG. 1.

Referring to the drawings, 1 represents a connector used as a substrate connector. The connector 1 has a rectangular housing 11. The housing 11 is used between a first substrate 111 and a second substrate 121 in such manner that one surface thereof is opposed to a surface of the first substrate 111 (FIG. 3) on which first contact pads 113 are arranged and the other surface thereof is opposed to a surface of the second substrate 121 on which second contact pads 123 are arranged. (FIG. 4.) Thus, the housing 11 provides continuity between the first contact pads 113 of the first substrate 111 and the second contact pads 123 of the second substrate 121.

The first substrate 111 and the second substrate 121 are, for example, circuit boards such as printed circuit boards used in various types of electronic devices. The first substrate 111 or the second substrate 121 may also include a semiconductor device such as an IC or LSI , or any type of electronic device as long as it includes contact pads (or electrodes) on one surface. In the drawings, the first substrate 111 and the second substrate 121 are circuit boards that include planar first contact pads 113 and second contact pads 123. The shape of the first and second contact pads 113,123 may take any shape such as a pad, a solder ball or a cube and in the embodiment in question the shape takes a pad having a flat surface.

The housing 11 is integrally formed of an insulating material and includes a plurality of terminal-receiving cavities 12, which penetrate the housing 11 in a direction of thickness thereof, that is, they preferably extend through the front and rear surfaces. In the example shown, the cavities 12 are arranged only in a partial area of the housing 11, but may be arranged in any arbitrary area as required and may be densely arranged over the entire surface area of the housing 11.

The cavities 12 each receive terminals 51 made of a conductive material. A portion of each terminal 51 protrudes from the front and rear surfaces of the housing 11. In the example shown, while the terminals 51 are accommodated only in some of the cavities 12, and they may be accommodated in an arbitrary number of cavities, for example, in all such cavities.

The cavities 12 and the terminals 51 are arranged so as to be in registration with the layouts of the first contact pads 113 on the first substrate 111 and the second contact pads 123 on the second substrate 121. In the drawings, the cavities 12 and the connection terminals 51 are arranged to form diagonal arrays at an angle of 45 degrees with respect to the side of the housing 11 and are arranged in a zigzag (or staggered) pattern. With this arrangement, it is possible to arrange a large number of terminals 51 within a certain area and densely arrange the terminals 51 at a small pitch. For example, in case the surface area of the housing 11 is around 1600 $mm^2$, it is possible to arrange about 1600 terminals 51 in a lattice-like pattern.

The housing 11 has a plurality of mounting holes 17 and each mounting hole 17 fastening member 131 for mounting the housing 11 between the first substrate 111 and the second substrate 121 is inserted. On the surface of the housing 11 opposed to the second substrate 121 are formed annular protrusions 17*a* surrounding the corresponding mounting holes 17, which are formed in the four corners, respectively. The annular protrusion 17*a* is formed to protrude from the surface of the housing 11 toward the second substrate 121. The upper end surface of the annular protrusion 17*a* abuts against the second substrate 121 and serves as a spacer for keeping a desired spacing between the housing 11 and the second substrate 121 in order to avoid over-tightening the fastening members 131. The annular protrusions 17*a* may be formed so as to surround the mounting holes 17 other than those in the four corners.

A plurality of first guide columns 16 protrude from the lower surface of the housing 11 toward the first substrate 111. A plurality of second guide columns 18 protrude from the upper surface of the housing 11 toward the second substrate 121. The first guide columns 16 and the second guide columns 18 have their tips engaged in respective first guide holes 114 formed in the first substrate 111 and second guide holes 124 formed in the second substrate 121, and serve to position the housing 11 with respect to the first and second substrate 111,121. This positioning allows each of the terminals 51 mounted on the housing 11 to be in registration with each first contact pads 113 of the first substrate 111 and each second contact pads 123 of the second substrate 121. First and second guide columns 16*a*,18*a* are formed in two groups of positions, one group where the columns are formed in mutually the same positions via the housing 11 and in the other group where the columns are formed in non-mutually different positions via the housing 11. Depending on the difference between theses positions, the guide columns can serve as polarizing keys indicating the correct connecting directions of the connector 1.

Figure 5:
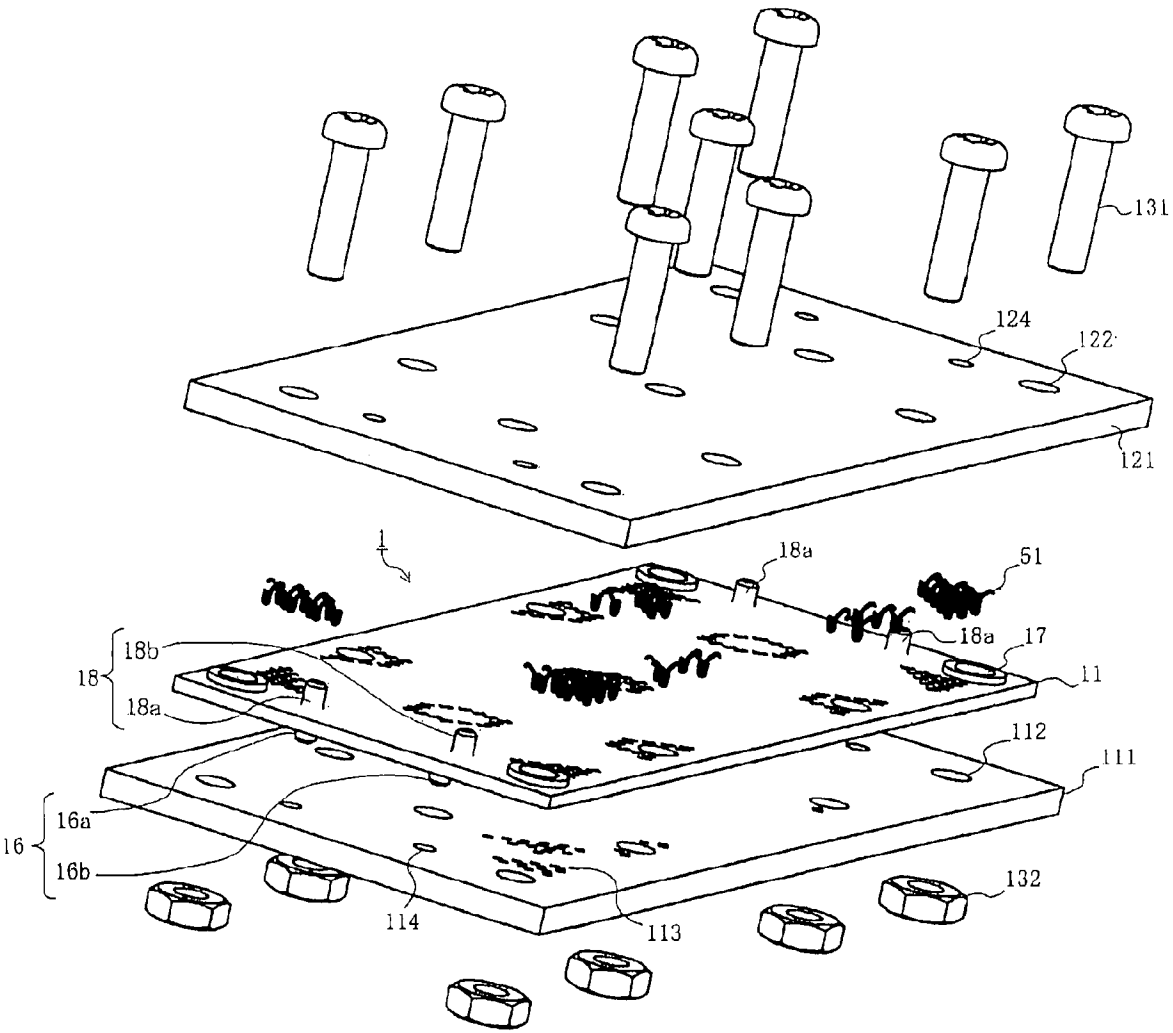
FIG. 5 is an exploded view of the assembly of FIG. 4.

As shown in FIG. 5, four first guide columns 16 and four second guide columns 18 are formed. Three pairs of first guide columns 16*a* and second guide columns 18*a* are formed the same position and a single pair of first and second guide column 16*b*,18*b* are formed in non-relatively different positions.

The first substrate 111 and the second substrate 121 each have a plurality of first mounting holes 112 and second mounting holes 122, which extend through the respective substrates 111 and 121. With the connector housing 11 pinched from both sides by the first and second substrate 111,121, the first and second guide columns 16,18 are engaged and fit into the first and second guide holes 114,124. Each mounting hole 17 of the housing 11, each first mounting hole 112 and each second mounting hole 122 are brought into alignment with one another. It is thus possible to insert a fastening member 131 through the aligned mounting hole 17, first mounting holes 112 and second mounting holes 122. Therefore, by screwing a nut 132 onto the fastening member 131, the first substrate 111 and the second substrate 121 are fastened together with the housing 11 pinched from both sides.

This allows the first and second substrates 111,121 to be connected via the connector 1 pinched therebetween. In FIG. 4, the connector 1 is disposed beneath and hidden by the second substrate 121 and is thus not seen.

Figure 6:
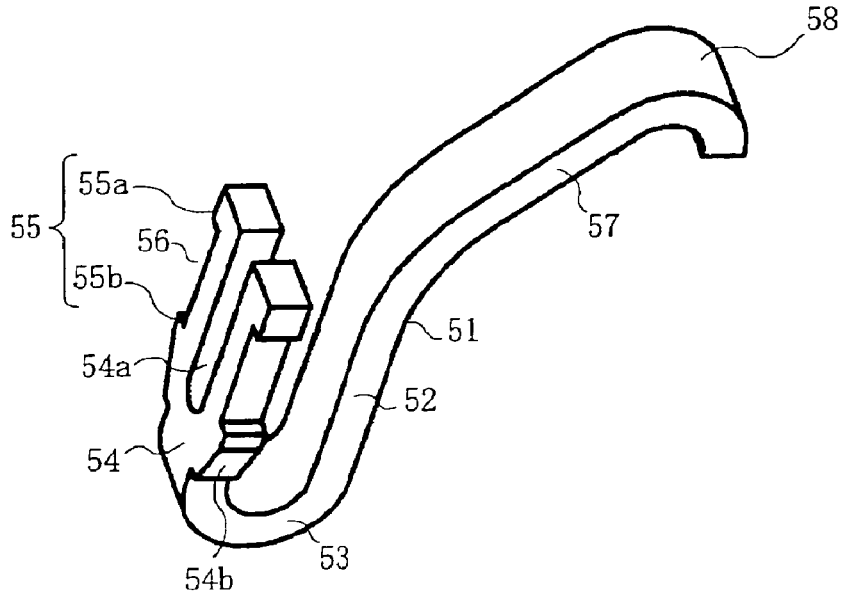
FIG. 6 is a perspective view showing a terminal used in the connector of FIG. 1.

As best shown in FIG. 6, the terminal 51 is constituted by a single member formed integrally by bending a long metal member, and has a substantial shape of a scoop or a hook. The terminal 51 includes a body portion 52 extending vertically, a first bending portion 53 connected to the bottom end of the body portion 52 and bent at an angle of almost 180 degrees, a vertical mounting portion 54 connected to the end of the first bending portion 53 (opposite to the body portion 52), a tilting portion 57 connected to the top end of the body portion 52 and tilting in a direction opposite to the bending direction of the first bending portion 53, and a second bending portion 58 connected to the top end of the tilting portion 57, with a free end oriented downward and bent in a direction opposite to the bending direction of the first bending portion 53. The first bending portion 53 functions as a first terminal contact that comes into contact with the first contact pad 113 of the first substrate 111 while the second bending portion 58 functions as a second terminal contact that comes into contact with the second contact pad 123 of the second substrate 121. The first and second terminal contacts have curved surfaces and, as shown in the drawings, the curved surfaces face in opposite directions.

The mounting portion 54 is bifurcated and is formed by a slot 54*a* extending vertically so that the terminal has the shape of a tuning fork. The mounting portion 54 therefore has two free arms and each arm has an upper and lower convex portion 55*a*,55*b* that are shown as projections, stubs or lugs. These projections 55*a*,55*b* define a concave portion, or recess, 56 between them. The upper convex portion 55*a* and the lower convex portion 55*b* will be referred to generally as a terminal convex portion 55.

The width of the cavity mounting portion 54 is larger than that of the terminal body portion 52, the first bending portion 53, the tilting portion 57 and the second bending portion 58. The lower side surface of the lower convex portion 55*b* is a tapered surface 54*b* gradually narrows in its width toward the lowermost end. By using the tapered surface 54*b*, it is possible to readily insert the terminal 51 into the housing cavities 12.

Figure 7:
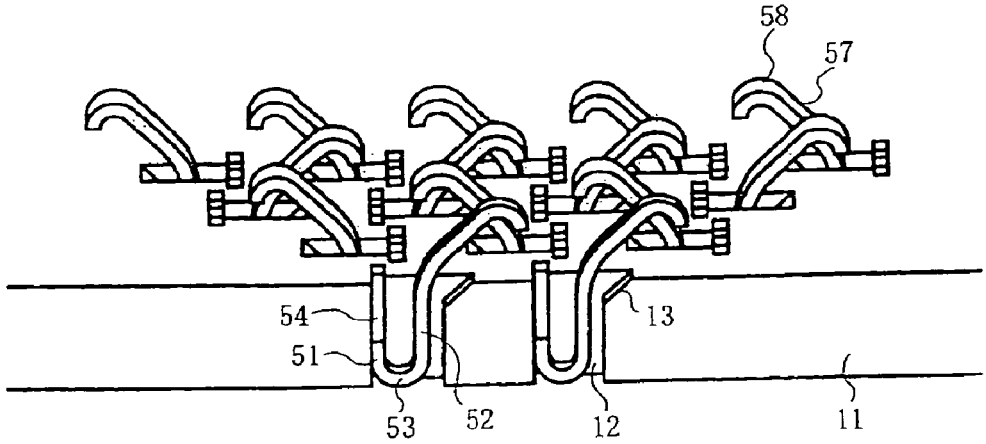
FIG. 7 is a first cross-sectional view of the connector of FIG. 1, showing a terminal accommodated in a terminal-receiving cavity thereof.
Figure 8:
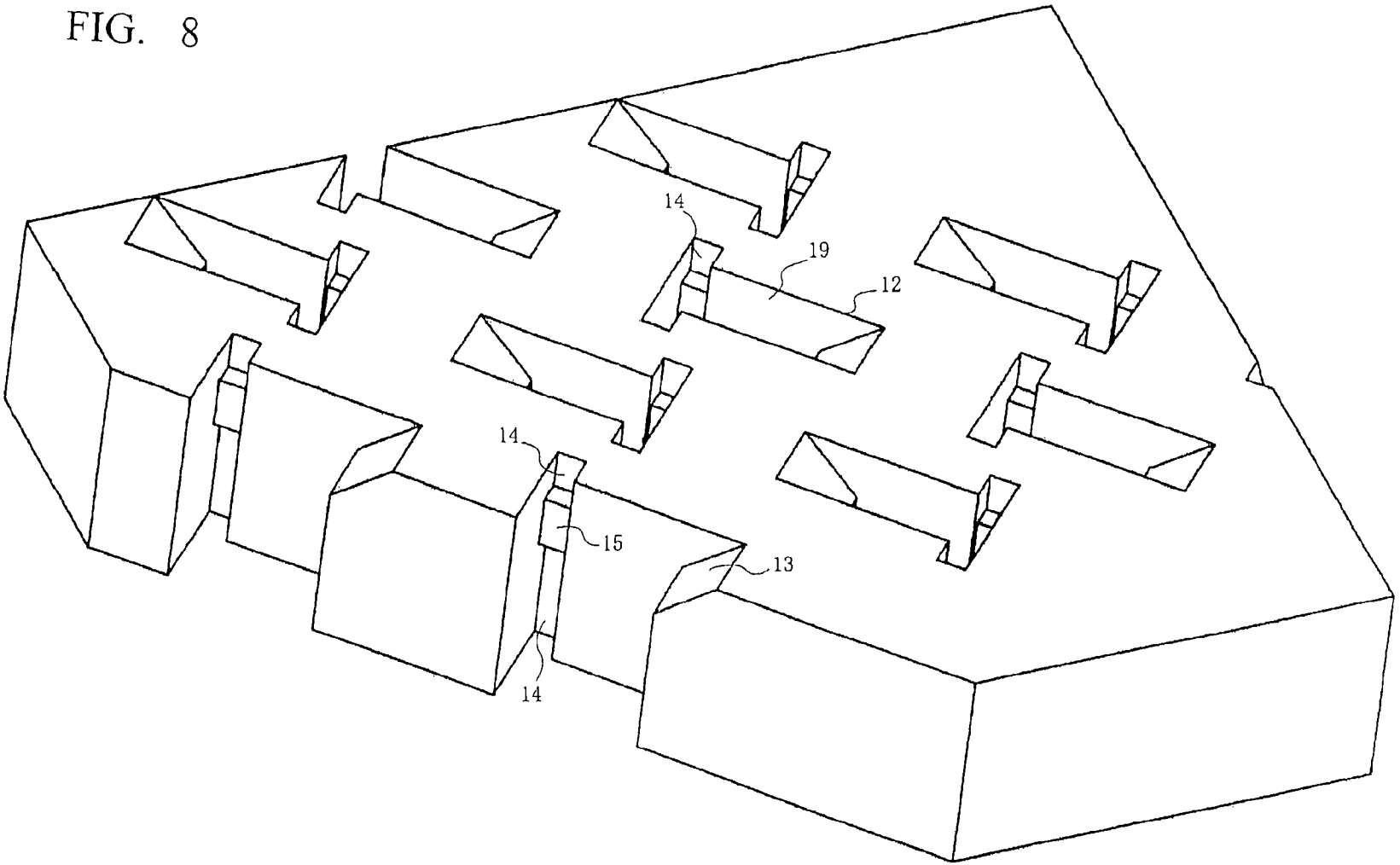
FIG. 8 is a perspective view, partly in cross-section, showing a housing of the assembly of FIG. 1.
Figure 9A:
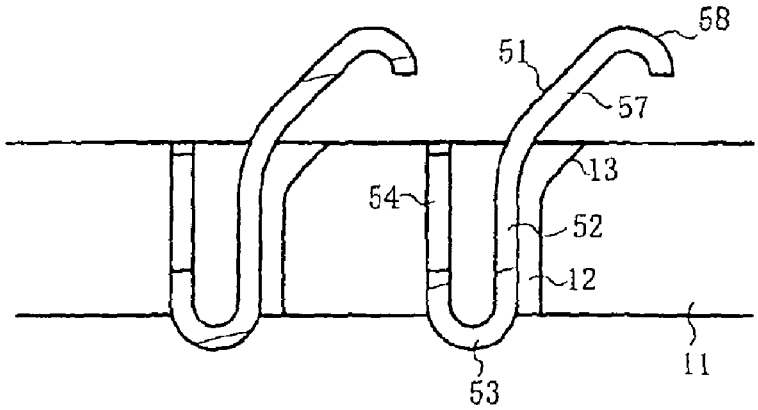
FIGS. 9*a*-9*c* are second cross-sectional views showing the terminal accommodated in the cavities, in which (a) the terminal is in the lowest position in the housing, (b) an intermediate state in the housing, and (c) the terminal is in the highest position in the housing.
Figure 9B:
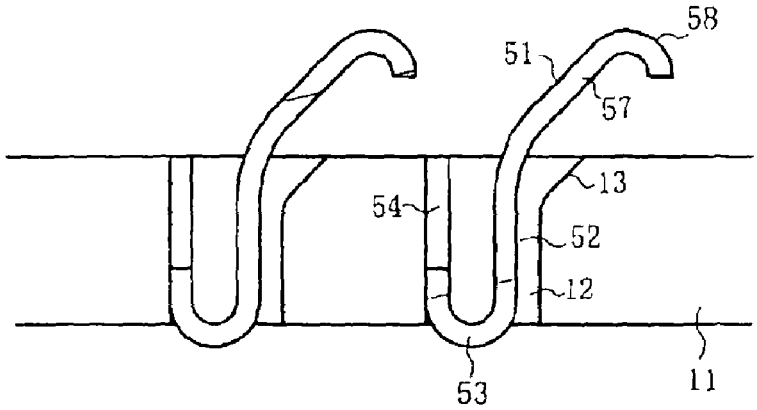
Figure 9C:
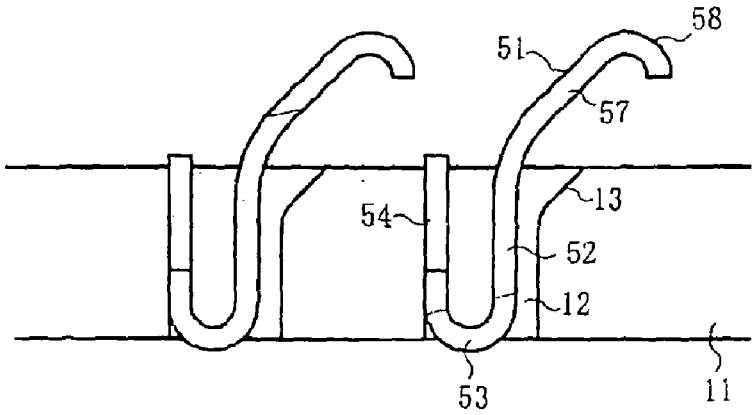
Figure 10A:
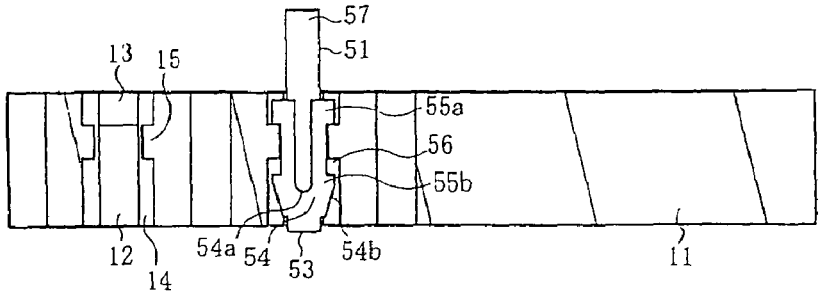
FIGS. 10*a*-10*c* are third cross-sectional views taken from an end, showing the terminal in the terminal-receiving cavities, in which (a) the terminal is in the lowest position in the housing, (b) an intermediate state in the housing, and (c) the terminal is in the highest position in the housing.
Figure 10B:
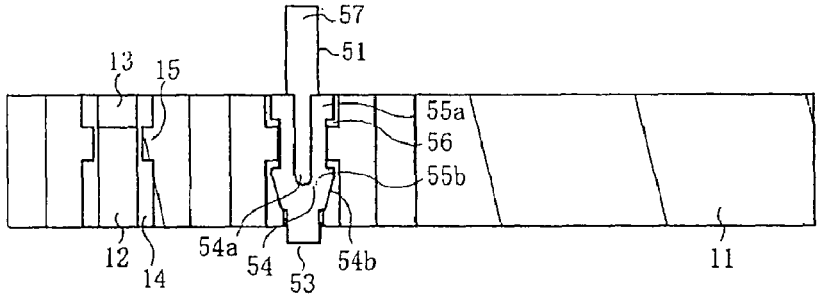
Figure 10C:
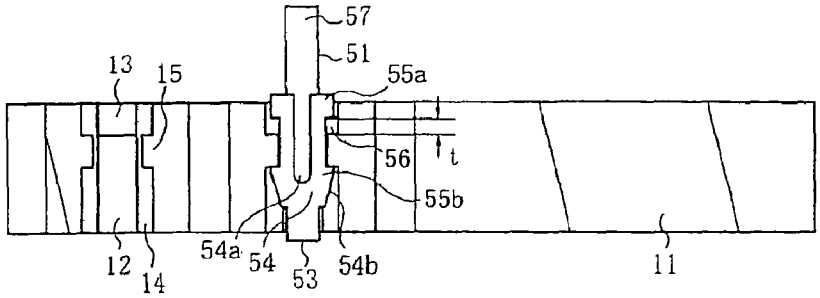

As shown in FIG. 8, each cavity 12 includes a tilted surface 13 formed in a portion close to a front surface close to the housing surface that opposes the second substrate 121. The tilted surface 13 tilts so as to correspond to the tilting portion 57 of the terminal 51 and, as shown in FIGS. 7 and 9, is opposed to the tilting portion 57 of the connection terminal 51 accommodated in the cavity 12. As best shown in FIG. 10, the cavity 12 includes a broad width part 14 and a narrow part 19 extending vertically in the housing 11, with the width of the narrow part 19 formed narrower than that of the broad width part 14. The broad width part 14 is formed in an area corresponding to the mounting portion 54 of the terminal 51 and has a width larger than that of the mounting portion 54 so as to accommodate the mounting portion 54. The narrow part 19 has a width larger than that of the first bending portion 53 and the body portion 52 so as to accommodate the first bending portion 53 of the terminal 51 and the body portion 52. The side wall of the narrow part 19 opposed to the body portion 52 is formed to be in continuation with the tilted surface 13 and functions as a wall that restricts the range in which the connection terminal 51 elastically deforms.

On the opposing inside surfaces on both sides of the broad width part 14 are formed respective convex parts, or lugs (or projections), 15, respectively, which protrude inwardly to the cavity. These lugs 15 engage in the concave portions 56 (recesses) of the mounting portion 54 of the terminal 51 when the terminal 51 is inserted in the cavity 12 and prevent the terminal 51 from being removed from the cavity 12. The projections are preferably four-sided in the shape of a square or rectangle as shown. The dimension of the cavity convex part 15 in the vertical direction (or length) is smaller than the vertical dimension of the terminal concave portion 56. Thus, the terminal 51 is held to move vertically within a predetermined range in the cavity 12. In the case of variations, or distortion or undulation of the first and second substrates are large, it is readily possible to increase a predetermined range "t" of the vertical movement of the terminal 51 by reducing the vertical dimension of the convex part 15 or increasing the vertical dimension of the concave portion 56 of the connection terminal 51, thus changing these dimensions. Preferably, the length of the concave portion 56 (recess) is greater than the length of the cavity projections 15.

As shown in FIGS. 9(*c*) and 10(*c*), the upper face of the broad width part 14 of the housing 11 is open. Thus, even when the terminal 51 is in the highest position in the housing 11, it is possible to position the upper end of the upper convex portion 55*a* of the connection terminal 51 above the surface of the housing 11 or, conversely, below the surface of the housing 11. In this way, the upper end of the upper convex portion 55*a* is not regulated by the housing 11 so that a wider predetermined range "t" may be readily set.

The predetermined range "t" is set based on the relation between the vertical dimension of the convex parts 15 and the vertical dimension of the concave portions 56 and is given by a value obtained by subtracting the vertical dimension of each convex part 15 from the vertical dimension of each concave portion 56. For example, the range "t" is set to about 100 μm in this embodiment.

As shown in FIGS. 9(*a*) and 10(*a*), where the terminal 51 is in the lowest position with respect to the housing 11, i.e., closest to the first substrate 111, the lower end of the upper convex portion 55*a* abuts the upper end of the convex part 15, which restricts any further downward movement of the terminal 51. As shown in FIGS. 9(*c*) and 10(*c*), where the terminal 51 is in the highest position in the housing 11, i.e., the position closest to the second substrate 121, the upper end of the lower convex portion 55*b* abuts the lower end of the convex part 15, which restricts any further upward movement of the terminal 51.

Even where the terminal 51 is in the highest position in the housing 11, the lower end of the first bending portion 53 is positioned below the rear surface of the housing 11, i.e., below the surface opposed to the first substrate 111. Where the terminal 51 is in the lowest position with respect to the housing 11, the upper end of the second bending portion 58 is positioned above the front surface of the housing 11, i.e., above the surface opposed to the second substrate 121. The lower end of the first bending portion 53 is set to a position being protruded by about 50 μm from the rear surface of the housing 11.

The terminal 51 is free to move vertically in the cavity 12, and is thus held therein in a floating state. In case the spacing between the housing 11 and the first substrate 111 or the second substrate 121 is not constant when the first substrate 111 and the second substrate 121 are connected with the connector 1 therebetween, the first bending portion 53 of the terminal 51 and the second bending portion 58 can maintain contact with the corresponding first contact pad 113 and second contact pad 123. It is possible to electrically connect the first and second substrate 111,121 even in case the housing 11, the first substrate 111 or the second substrate 121 is subjected to distortion or warpage.

Figure 11:
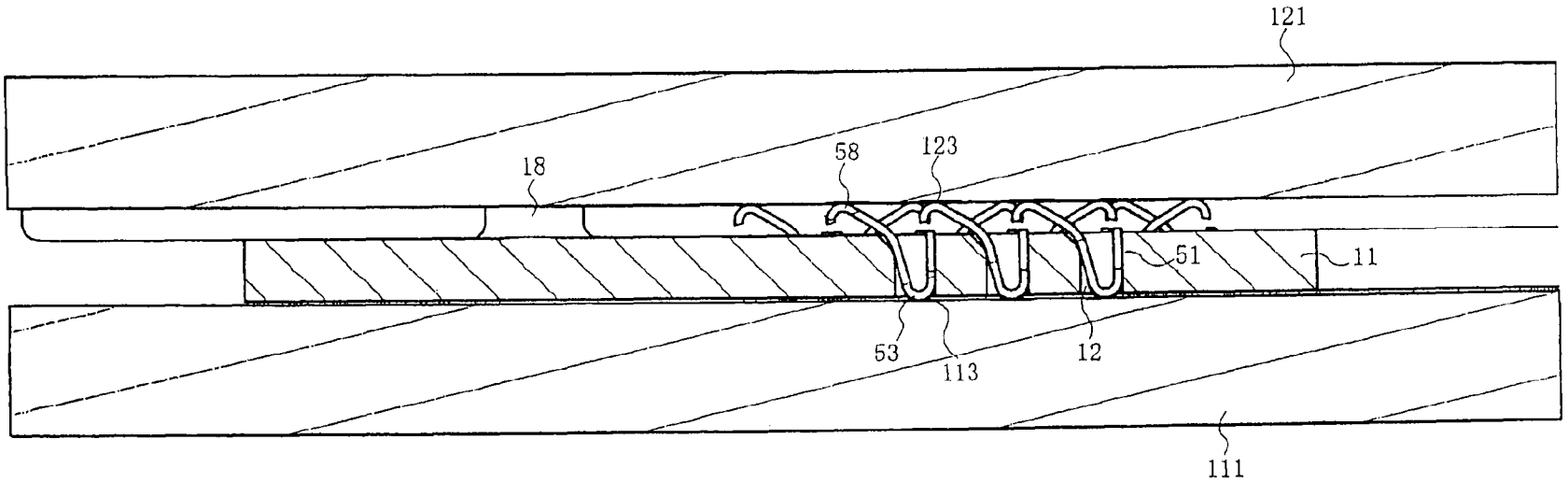
FIG. 11 is a cross-sectional view showing the connector of the present invention to a first and second substrate.

When the first substrate 111 and the second substrate 121 are fastened together with the housing 11 pinched therebetween, each of the connection terminals 51 is elastically deformed due to the spring property thereof. In this case, the first and second bending portion 53,58 are brought into contact with the first and second contact pads 113,123 and are pressed from above and below. The body portion 52, the first bending portion 53, the tilting portion 57 and the second bending portion 58 are thereby elastically deformed. In addition, as best shown in FIG. 11, the tilting portion 57 is further inclined and the second bending portion 58 is deformed so as to approach the surface of the housing 11.

Because the housing cavities 12 have at their portion adjacent to the surface thereof, the tilting surface 13 formed thereon, the body portion 52 or the tilting portion 57 does not interfere with the end of the cavity 12 close to the surface but, rather is flexibly deformed. The tilting portion 57 tilts in a direction opposite to the bending direction of the first bending portion 53 and moves away from the mounting portion 54 toward the tip end. In other words, the tilting portion 57 forms an acute angle with respect to the surface of the housing 11 and has a gradually widening shape. Thus, the terminal body portion 52 or tilting portion 57 are more flexibly deformed.

When the terminal 51 deforms, the side surface of each of the upper convex portion 55*a* and the lower convex portion 55*b* of the terminal 51 is pressed against the side surface of the cavity broad width part 14 close to the tilting surface 13. In this state, it is possible to stabilize the position of each terminal 51 in the cavity 12. Furthermore, the stress of deformation concentrates on the mounting portion 54 when the tilting portion 57 of the terminal 51 moves. The mounting portion 54 is engaged with the housing 11 at two sections on the side surface of the upper convex portion 55*a* and two sections on the side surface of the lower convex portion 55*b*, total four sections. This prevents possible deformation of the mounting portion 54 caused by a stress thereby smoothly deforming the terminal 51.

In this way, the terminal 51 is deformed elastically and flexibly. Even when the spacing between the housing 11 and the first substrate 111 or the second substrate 121 is not constant, the first bending portion 53 and the second bending portion 58 of the connection terminal 51 can keep contact with the first contact pad 113 and the second contact pad 123. Thus, even in case the housing 11, the first substrate 111 or the second substrate 121 is distorted or warped, it is possible to electrically connect the first substrate 111 and the second substrate 121. The first substrate 111 and the second substrate 121 are not subject to strong counterforces from the connection terminals 51 so that they are free from damage.

Further, elastic force generated by elastic deformation of the terminals 51 energizes the first bending portion 53 and the second bending portion 58 toward the first contact pads 113 and the second contact pads 123, which secures contact with the above-mentioned first and second contact pads 113 and 123.

A change in the inclination of the tilting portion 57 causes the second bending portion 58 to move in a direction parallel to the housing 11 and rub against the surface of the second contact pads 123. This generates a wiping effect that removes any foreign substance attached to the surfaces of the second bending portions 58 and the second contact pads 123 that hampers electrical conductivity. This ensures reliable electrical continuity between the second bending portions 58 and the second contact pads 123.

Furthermore, the terminal 51 includes the tilting portion 57 and is thus capable of absorbing contact pressure generated in connection to the second substrate 121 in vertical direction as well as tilting direction. The terminal 51 is not buckled in vertical direction and is free from damage.

Between the inner side surface at either side of the broad width part 14 in the cavity 12 and the upper convex portion 55*a* or the lower convex portion 55*b* at either side of the mounting portion 54 of the terminal 51 accommodated in the cavity 12 is a small clearance that will not prevent vertical movement of the terminal 51. Between the convex part 15 at either side of the broad width part 14 and the concave portion 56 at either side of the mounting portion 54 is also a small clearance that will not prevent vertical movement of the terminal 51. Thus, the terminal 51 is held in the cavity 12 while being allowed to move widthwise of the mounting portion 54, or horizontally, within the range of the clearance. The upper convex portion 55*a* and the lower convex portion 55*b* may move in opposite directions to each other to allow the terminal 51 to tilt. In this way, the terminal 51 is held in the cavity 12 in a state where not only vertical and horizontal movement and tilting are allowed. In case the housing 11, the first substrate 111 or the second substrate 121 are distorted or warped, the connector still reliably provides electric connection between the first substrate 111 and the second substrate 121.

For mounting, each terminal 51 is lowered from above with the first bending portion 53 facing downward to insert the connection terminal 51 into the cavity 12. In this process, the lower convex portion 55*b* of the mounting portion 54 abuts the convex part 15 at either side of the broad width part 14.

The lower side surface of the lower convex portion 55*b* is a tapered surface 54*b* that becomes narrower toward the lowermost end. The portion of the mounting portion 54 bifurcated laterally is elastically deformed and tilts inward, which allows the lower convex portion 55*b* to smoothly pass through the convex parts 15 on both sides. Therefore, it is possible to readily insert the terminals 51 into the cavities 12 to accommodate the terminals 51 therein. By accommodating the terminals 51 in each cavity 12, it is possible to obtain the substrate connector 1 of which the terminals 51 are mounted on the housing 11 as shown in FIG. 1. By elastically deforming, with the manual operation of an operator or use of a tool, the portion of the mounting portion 54 which is bifurcated laterally so as to be inwardly inclined, it is possible to easily remove each of the terminals 51 from the corresponding terminal-accommodating recessed part 12. Thus, the terminals 51 may be readily removed if damaged or contaminated. Accordingly, it is possible to selectively replace a single terminal 51 with a spare in an individual manner.

Figure 3:
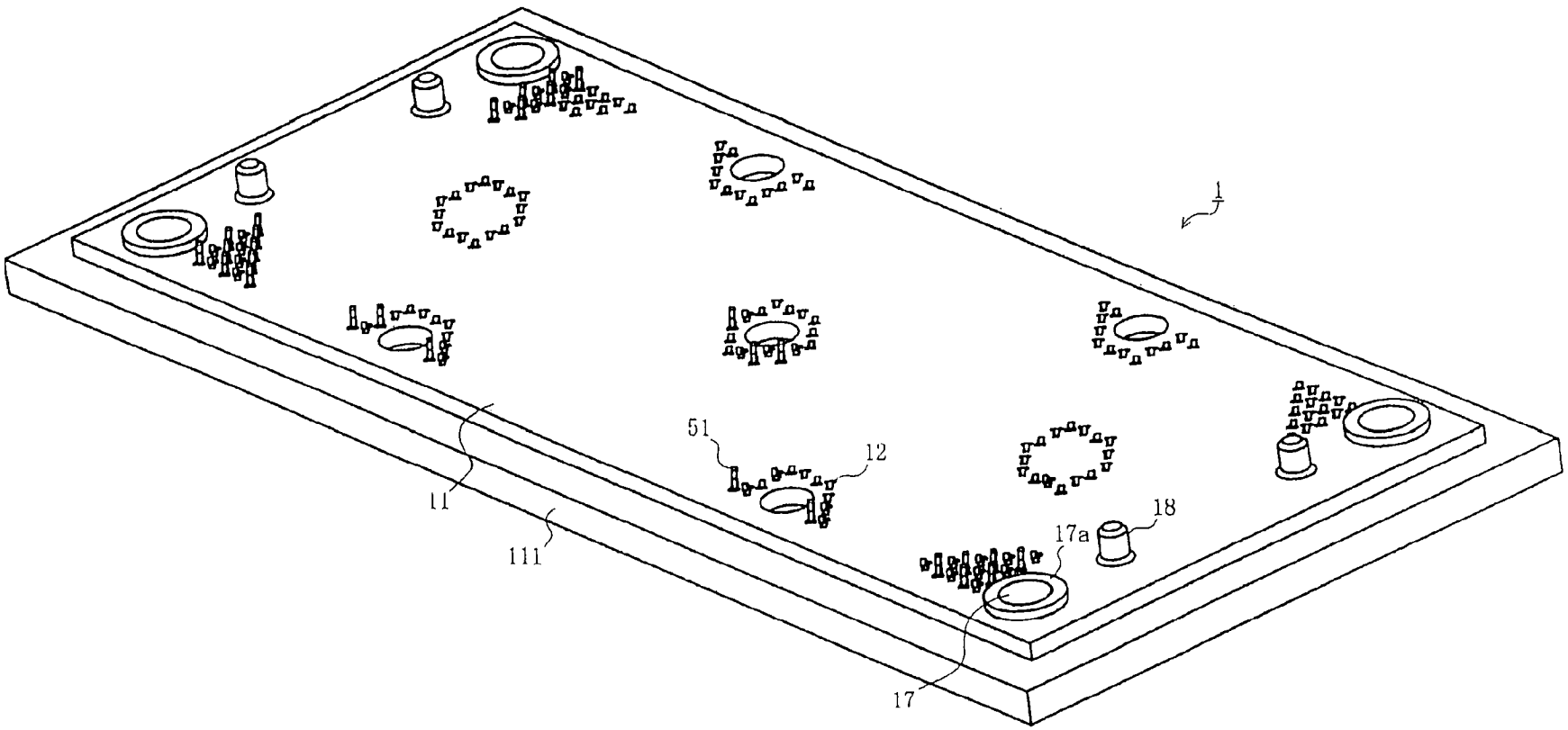
FIG. 3 is a perspective view of FIG. 2 showing the state where the connector is connected to a first substrate.
Figure 4:
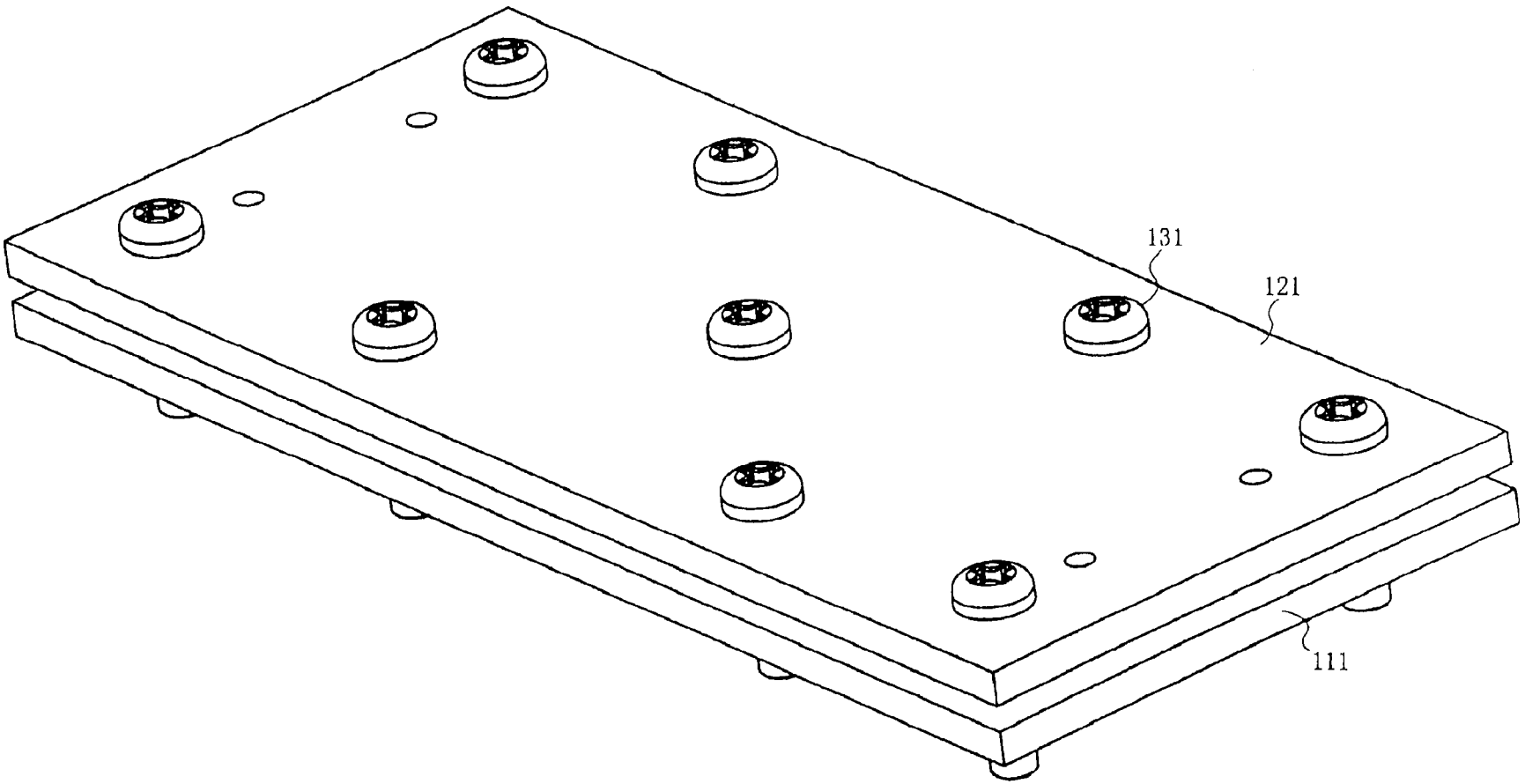
FIG. 4 is a perspective view of the connector of FIG. 3 showing the connector connected to both a first and second substrate.

The first substrate 111 and the second substrate 121 are connected to each other by the connector 1, and the connector 1 is connected to the surface of the first substrate 111 on which the first contact pads 113 are arranged as shown in FIG. 3. In this case, the first guide columns 16*a*, 16*b* protrudes from the rear surface of the housing 11 and are fitted into the first guide hole 114 formed in the first substrate 111. This positions the housing 11 and the first substrate 111 and causes the first bending portion 53 of each terminal 51 to contact the corresponding first contact pads 113. In this stage, the terminals 51 are arranged in the lowest position or in a position above the lowest position in response to a variation in the vertical position of each first contact pad 113 caused by distortion or undulation of the first substrate 111.

Subsequently, the connector 1 is connected to the surface of the second substrate 121 on which the second contact pads 123 are arranged. The second guide column 18 protrudes from the surface of the housing 11 and is fitted into the second guide hole 124 of the second substrate 121. The positioning of the housing 11 with respect to the second substrate 121 is achieved and causes the second bending portion 58 of each terminal 51 to contact the surface of the corresponding second contact pad 123. The upper end surface of the annular protrusion 17*a* protruding from the surface of the housing 11 abuts the second substrate 121, thus keeping the spacing between the housing 11 and the second substrate 121.

Finally, the fastening members 131 are inserted into the mounting holes 17, the first mounting holes 112 and the second mounting holes 122 and nuts 132 are screwed onto the fastening members 131 to fasten the first and second substrates 111,121 together. Where the first substrate 111 and the second substrate 121 are gradually fastened together, the second bending portion 53 of each terminal 51 is pushed up by the first contact pad 113 of the first substrate 111 and the second bending portion 58 and the tilting portion 57 of the terminal 51 are tilted by the second contact pad 123 of the second substrate 121 and are deformed downward. In this process, a stress is exerted on the terminal 51 in the tilting direction of the tilting portion 57 so that the side surfaces of upper convex portion 55*a* and the lower convex portion 55*b* of the mounting portion 54 are pressed by the side surface of the broad width part 14 close to the narrow part. The housing 11 of the connector 1 includes a cavity 12 in the housing 11 in the direction of thickness and accommodating the terminal 51. The terminal 51 includes a mounting portion 54 that is bifurcated by a vertical slot 54*a* and the mounting portion 54 includes concave portions 56 formed on its outer edges. The cavity 12 is provided with the broad width part 14 having a width larger than that of the mounting portion 54 to accommodate the mounting portion 54. The convex part 15 protruding inward from the inner side surface of the broad width part 14 is engaged with a concave portion 56 to hold the terminal 51 so as to allow it to move vertically and horizontally.

Even if the housing 11, the first substrate 111 or the second substrate 121 is distorted or warped, it is possible to appropriately absorb variation in the spacing between the first or second substrate 111,121 and the housing 11 thereby keeping contact between the first substrate 111 and the second substrate 121. It is also possible to simplify the structure of the connector 1, thus reducing costs.

The terminal 51 includes the first bending portion 53 connected to an end of the mounting portion 54 close to the first substrate 111, a body portion 52 whose end close to the first substrate 111 is connected to the first bending portion 53, the tilting portion 57 connected to the end of the body portion 52 close to the second substrate 121 and tilting in a direction opposite to the bending direction of the first bending portion 53, and the second bending portion 58 connected to the end of the tilting portion 57 close to the second substrate 121 and bent in a direction opposite to the bending direction of the first bending portion 53. The first bending portion 53 of the terminals 51 contacts the first contact pads 113 and the second bending portions 58 contact the second contact pads 123, causing the terminal 51 to elastically deform and absorb any variation in the distance between the first and second contact pads 113,123.

In this way, the terminal 51 is deformed elastically and flexibly. Even when the spacing between the housing 11 and the first or second substrate 111,121 are not constant, the first and second bending portions 53,58 of each terminal 51 can contact with corresponding first and second contact pad 113, 123. Thus, even where the housing 11, the first substrate 111 or the second substrate 121 are distorted or warped, it is possible to reliably connect the first and second substrates 111,121. Elastic force generated by the elastic deformation of the terminals 51 energizes the first and second bending portions 53,58 toward the first and second contact pads 113,123, which ensures contact with the first and second contact pads 123. A change in the inclination of the tilting portions 57 generates a wiping effect that removes any foreign substance attached to the surfaces of the second bending portions 58 and the second contact pads 123 that hampers electrical continuity. This ensures continuity between the second bending portions 58 and the second contact pads 123.

Figure 12:
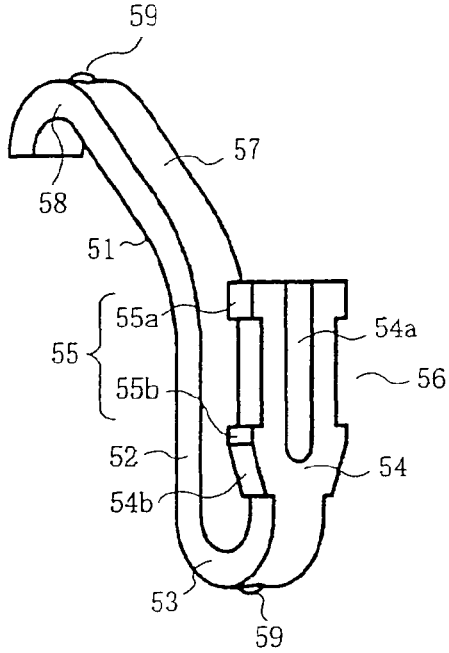
FIG. 12 is a perspective view showing a terminal according to a second embodiment of the present invention.
Figure 13:
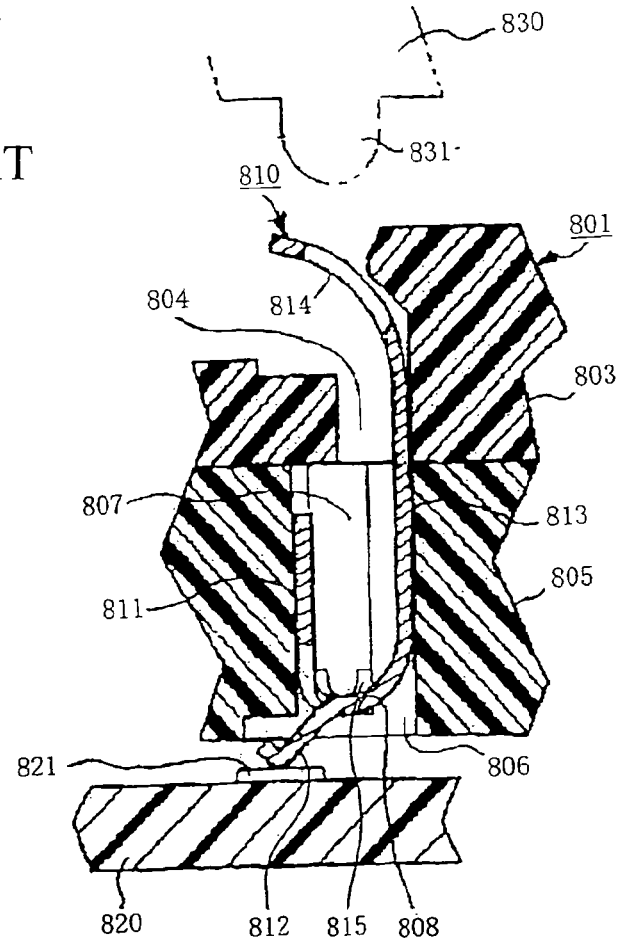
FIG. 13 PRIOR ART
FIG. 13 is a cross-sectional view of a conventional connector.

FIG. 12 is a perspective view showing a terminal according to the second embodiment of the present invention. As shown in FIG. 12, a protrusion 59 is formed at the lower end of a first bending portion 53 and also at the upper end of a second bending portion 58 of a terminal 51. The protrusions 59 come into contact with the first and second contact pads 113,123 so that the contact pressure per unit area is higher, which further ensures electric connection between the first bending portion 53 and the second bending portion 58 and the first and second contact pad 113,123 respectively. Other configurations and operations are the same as those in the afore-described first embodiment so that corresponding description is omitted.

The present invention is not limited to the above-described embodiments, and may be changed and modified in various ways based on the gist of the present invention, and these changes and modifications should not be eliminated from the scope of the present invention as defined by the appended claims.

What is claimed is:

1. A connector for connecting two substrates together, the connector comprising:

an insluative housing, the insulative housing including a plurality of terminal-receiving cavities disposed therein, each terminal-receiving cavity extending completely through the insulative housing and including a base with a first width and first and second opposing ends, the first opposing end having an enlarged portion with a second width that is greater than the first width, and the enlarged portion having a pair of opposing terminal-engaging projections extending sidewardly into the terminal-receiving cavity; and a plurality of conductive terminals, each conductive terminal being received in one of the terminal-receiving cavities and including first and second free ends, each conductive terminal being bent partially upon itself to define a hook-like configuration, the first free end defining a U-shaped terminal retention portion, and the second free end defining a second contact portion of the conductive terminal, with the conductive terminal having a first contact portion disposed proximate to a location on the conductive terminal where the conductive terminal is bent upon itself;

wherein:

the U-shaped terminal retention portion includes a longitudinal slot disposed in the first free end, the longitudinal slot defining two free arms, each free arm including a pair of spaced-apart projections defining a recess therebetween, each recess engaging one of the terminal-engaging projections and including a length greater than the length thereof so that the conductive terminal has limited movement within the terminal-receiving cavity; and the second contact portion is disposed at the second free end.

2. The connector of claim 1, wherein each terminal-receiving cavity further includes an angled wall opposing the second free end.

3. The connector of claim 2, wherein each conductive terminal further includes an angled portion disposed between the first and second contact portions.

4. The connector of claim 1, wherein the first and second contact portions include curved surfaces that face in opposite directions.

5. The connector of claim 4, wherein each curved surface includes a protrusion.

6. The connector of claim 1, wherein each conductive terminal includes an angled portion in opposition to the cavity angled portion.

7. The connector of claim 6, wherein the angled portion is separated from the first free end by a second bend in the conductive terminal.

* * * * *